US007232333B2

(12) United States Patent
Chen

(10) Patent No.: US 7,232,333 B2
(45) Date of Patent: Jun. 19, 2007

(54) METHOD FOR CONNECTING A TERMINAL TO A CONNECTOR AND STRUCTURE OF THE TERMINAL

(75) Inventor: Ying Chung Chen, Pan Chiao (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 11/274,017

(22) Filed: Nov. 15, 2005

(65) Prior Publication Data

US 2006/0199410 A1 Sep. 7, 2006

(30) Foreign Application Priority Data

Mar. 2, 2005 (TW) ..... 94106275 A

(51) Int. Cl.
*H01R 12/24* (2006.01)

(52) U.S. Cl. ..... 439/495

(58) Field of Classification Search ..... 439/495, 439/496, 499, 260, 326, 259
See application file for complete search history.

(56) References Cited

U.S. PATENT DOCUMENTS 5,842,883 A * 12/1998 Igarashi et al. ..... 439/495
6,383,017 B1 * 5/2002 Takayasu ..... 439/495
6,755,682 B2 * 6/2004 Kunishi et al. ..... 439/495
6,921,274 B2 * 7/2005 Yu ..... 439/260

* cited by examiner

*Primary Examiner*—Alexander Gilman

(57) ABSTRACT

A connector includes a passage defined in a rear end thereof and a cover is pivotably connected to the connector. The cover includes a plurality of engaging teeth defined in an underside thereof and an axle passing through the engaging teeth. A terminal has a base from which a contact arm and a connection arm extend. The contact arm has a terminal contact end at a distal end thereof and the connection arm has a connection portion projecting from a distal end thereof. A notch is defined in the connection portion. A sharp plate extends from a top side of the connection arm. The terminal extends through the passage of the connector and the axle of the cover is engaged with the notch of the connection arm and the sharp plate is securely in contact with the inside of the passage of the connector.

7 Claims, 9 Drawing Sheets

METHOD FOR CONNECTING A TERMINAL TO A CONNECTOR AND STRUCTURE OF THE TERMINAL

BACKGROUND OF THE INVENTION

1. Field of the Invention

The present invention relates generally to a connection of a connector and a terminal, and in particular to a terminal with a connection arm which is connected to the axle of the cover.

2. The Prior Arts

A conventional way of connection of the terminal 30 and the connector 10 is disclosed in FIGS. 1A and 1B, wherein the connector 10 includes a passage defined in a rear end thereof and two engaging recesses are defined in two ends of the connector 10. A cover 12 including two positioning rods is connected to the connector 10 by engaging the positioning rods into the engaging recesses so that the cover 12 is pivotable about the positioning rods. Both positioning rods and engaging recesses are located at the inner sides of two ends of the connector 10 and therefore not visible in the figures. A plurality of engaging teeth 12*a* is defined in an underside of the cover 12. A space is defined between the passage and the engaging recesses so that a flatcable can be inserted into the space and the cover 12 is then closed to let the line contact ends be in contact with the terminal contact ends.

Referring to FIG. 2, the cover 12 includes an axle 12*b* which passes through the engaging teeth 12*a*. The two positioning rods are formed at the two ends of the axle 12*b*. When the terminal 30 extends through the passage, a connection arm 30*b* of the terminal 30 is engaged with the axle 12*b* of the cover 12 by means of a notch 30*d* as shown in FIG. 3A. The cover 12 is then pivoted to its open position as shown in FIG. 3B and a flatcable 40 is inserted into the space as shown in FIG. 3C. As shown in FIG. 3D, the cover 12 is then pivoted downward to its close position and the contact arm 30*a* of the terminal 30 is deformed slightly and the flatcable 40 is clamped between the cover 12 and the contact arm 30*a*.

SUMMARY OF THE INVENTION

A connector includes a passage defined in a rear end thereof and a cover is pivotably connected to the connector. The cover includes a plurality of engaging teeth defined in an underside thereof and an axle passing through the engaging teeth. A terminal has a base from which a contact arm and a connection arm extend. The contact arm has a terminal contact end at a distal end thereof and the connection arm has a connection portion projecting from a distal end thereof. A notch is defined in the connection portion. A sharp plate extends from a top side of the connection arm. The terminal extends through the passage of the connector and the axle of the cover is engaged with the notch of the connection arm and the sharp plate is securely in contact with the inside of the passage of the connector.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
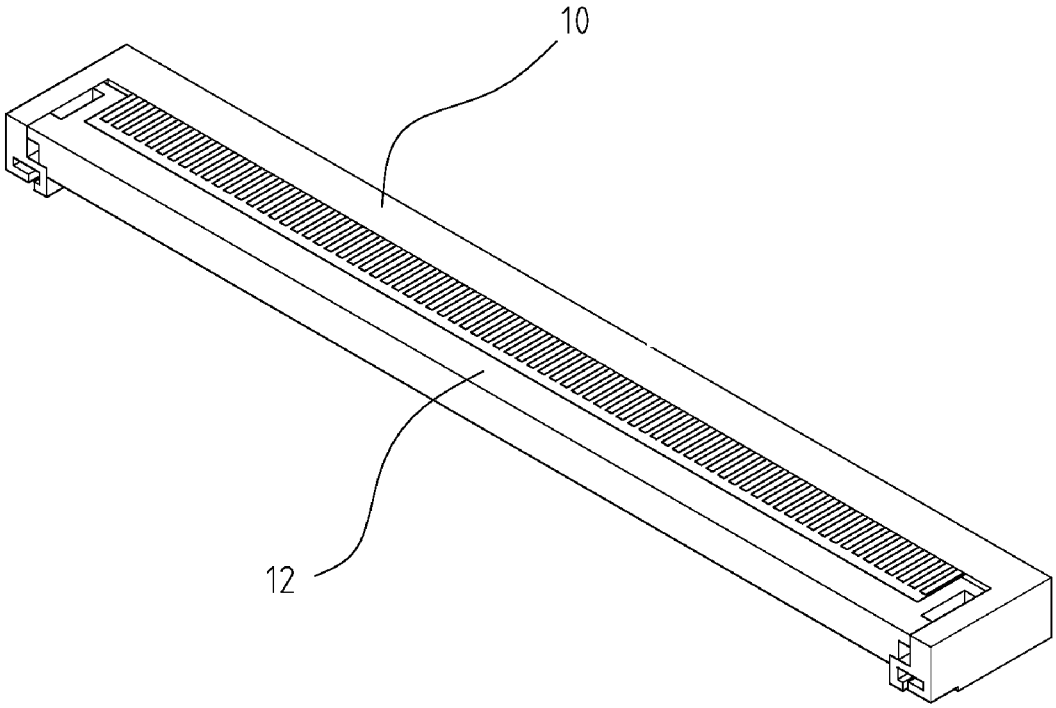
FIG. 1A (PRIOR ART)
FIG. 1A shows a conventional connector with a cover.
Figure 1B:
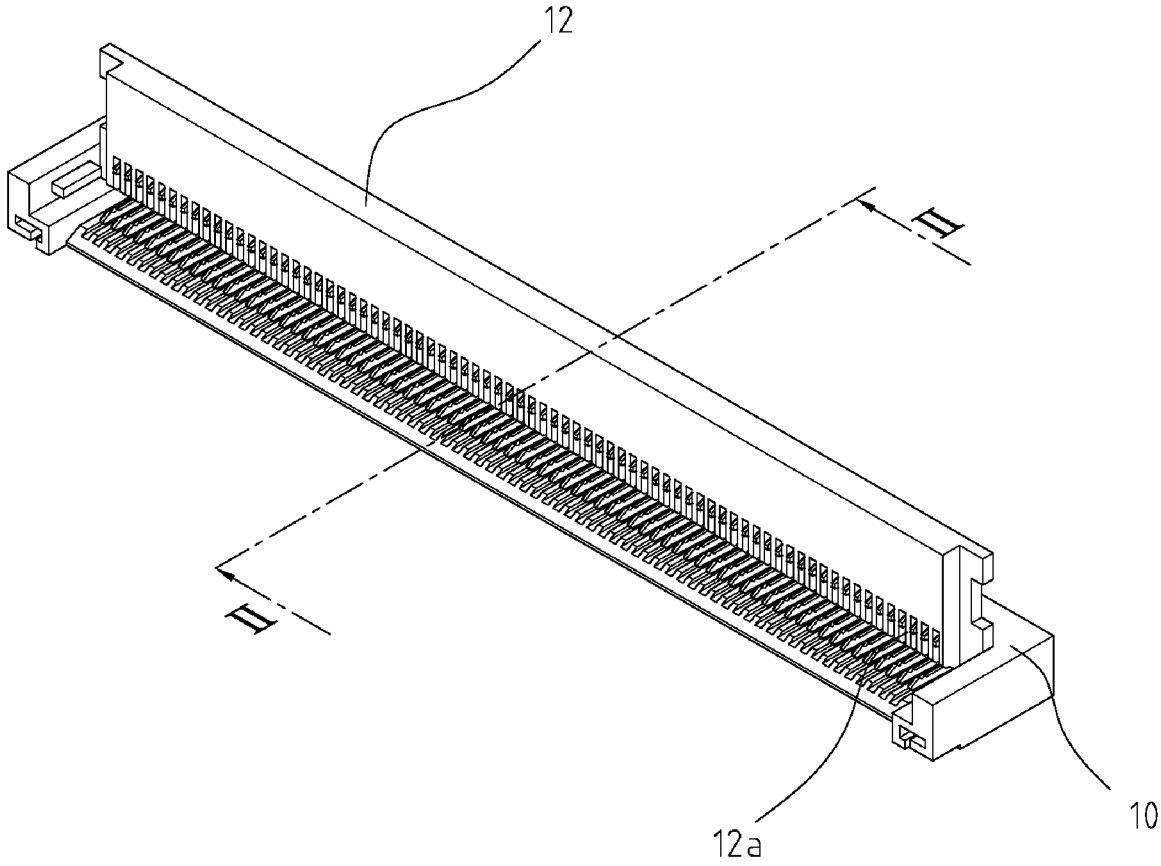
FIG. 1B (PRIOR ART)
FIG. 1B shows that the cover is pivoted to its open position relative to the connector in FIG. 1A.
Figure 2:
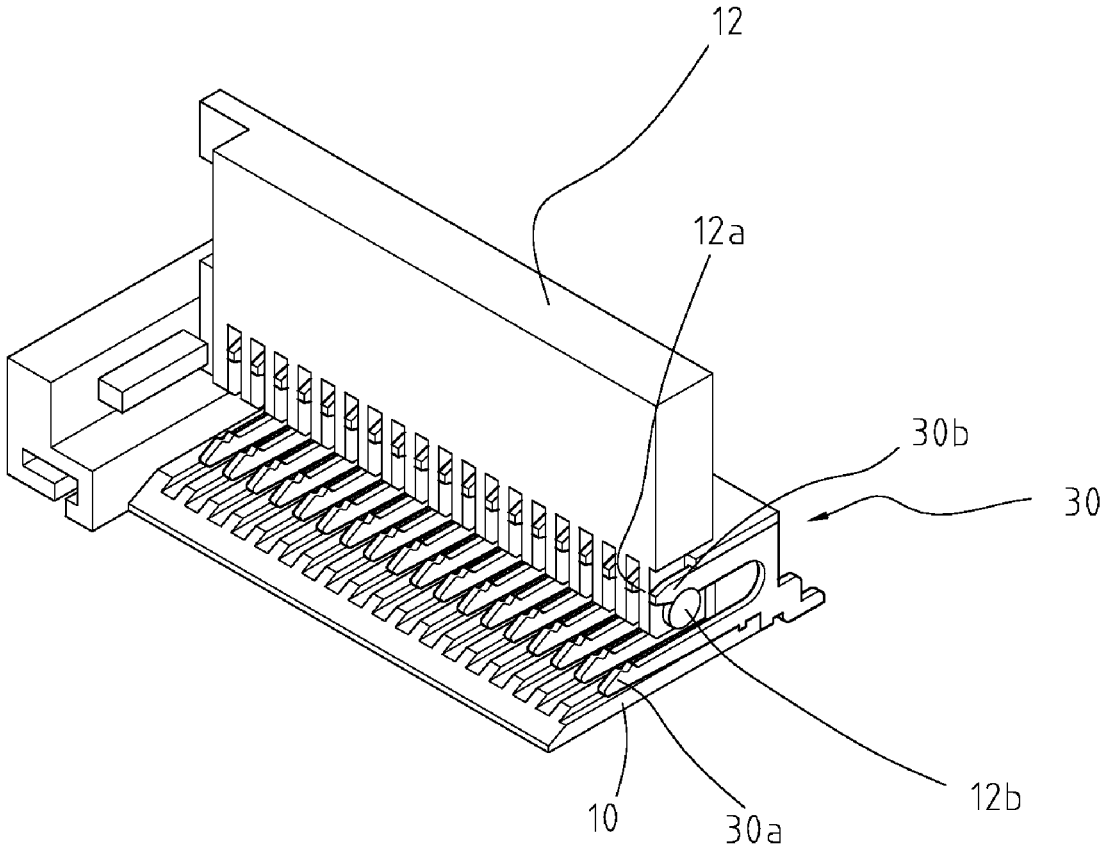
FIG. 2 (PRIOR ART)
FIG. 2 is a cross-sectional view taken along line II—II for showing a conventional terminal inserted into the connector.
Figure 3A:
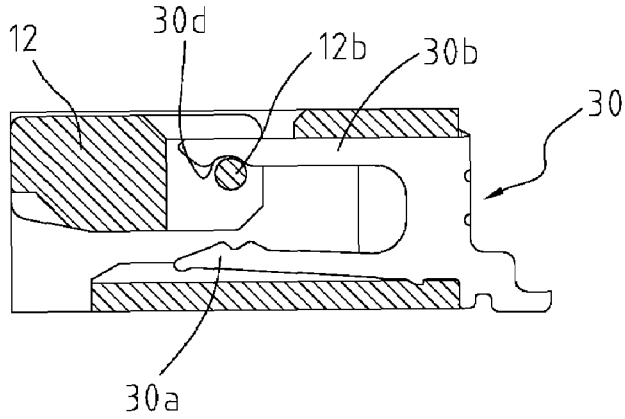
FIG. 3A (PRIOR ART)
FIG. 3A is a cross sectional view to show that the conventional terminal is inserted into the connector.
Figure 3B:
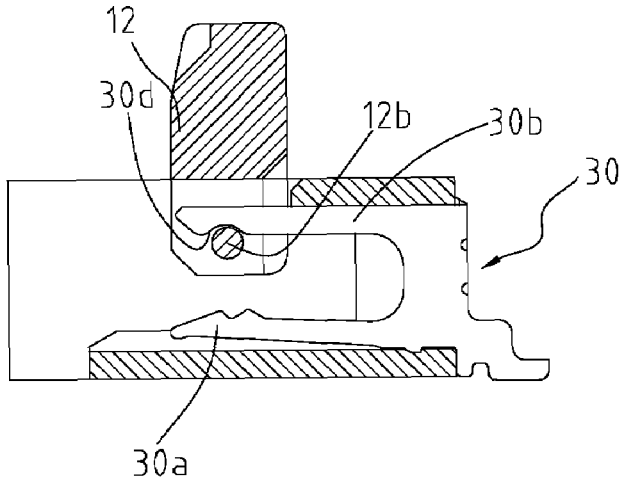
FIG. 3B (PRIOR ART)
FIG. 3B is a cross sectional view to show that the cover is pivoted and the axle is slightly disengaged from the conventional terminal.
Figure 3C:
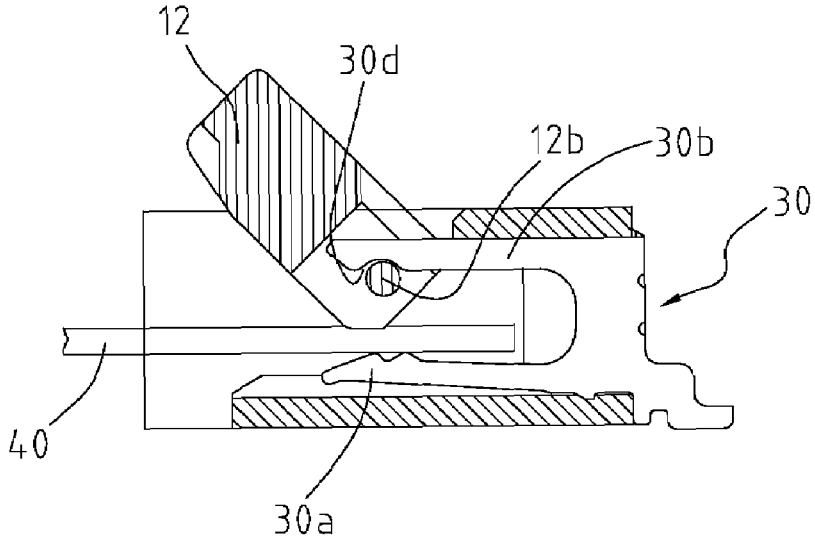
FIG. 3C (PRIOR ART)
FIG. 3C shows that the axle is removed from the conventional terminal when the cover is pivoted to its close position.
Figure 3D:
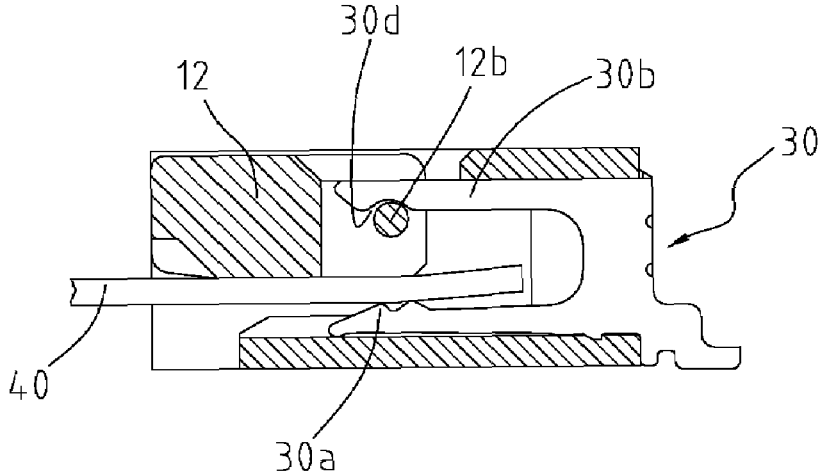
FIG. 3D (PRIOR ART)
FIG. 3D shows that the axle is completely disengaged from the conventional terminal when the cover is closed.
Figure 4:
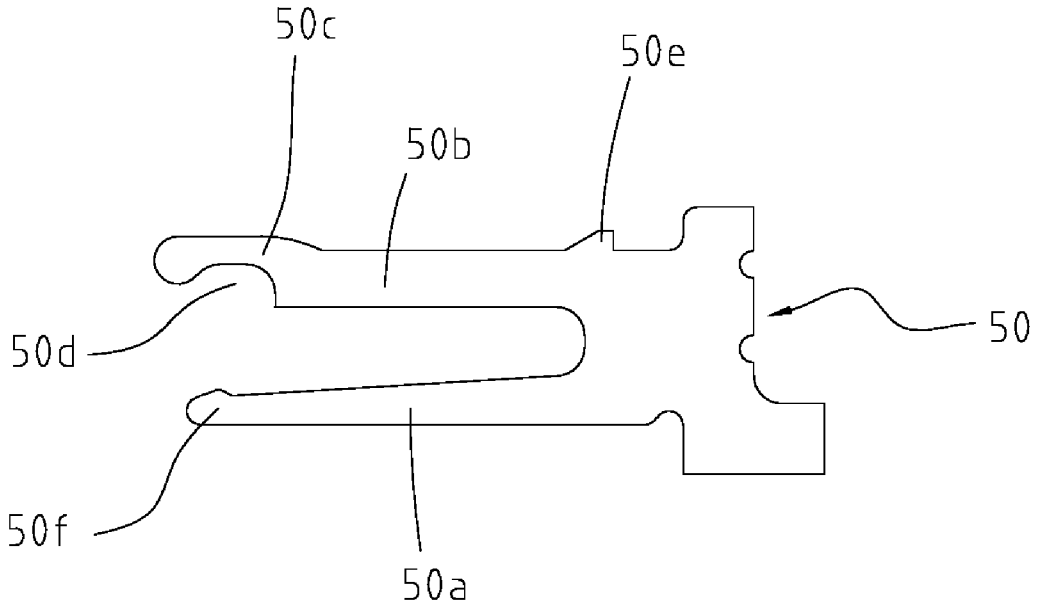
FIG. 4 shows the terminal of the present invention.

With reference to the drawings and in particular to FIG. 4, the terminal 50 of the present invention is a metal plate and has a base from which a contact arm 50*a* and a connection arm 50*b* extend. The contact arm 50*a* has a terminal contact end 50*f* at a distal end thereof and the connection arm 50*b* has a connection portion 50*c* projecting from a distal end of a top thereof and a notch 50*d* is defined in the connection portion 50*c*. A sharp plate 50*e* extends from a top side of the connection arm 50*b*.

The connector 10 cooperated with the terminal 50 includes a passage defined in a rear end thereof and two engaging recesses are defined in two ends of the connector 10. A cover 12 has two positioning rods on two ends thereof and the positioning rods are engaged with the engaging recesses. A plurality of engaging teeth 12*a* are defined in an underside of the cover 12 and an axle 12*b* is located between the engaging teeth 12*a*. A space is defined between the passage and the engaging recesses of the connector 10.

Figure 5A:
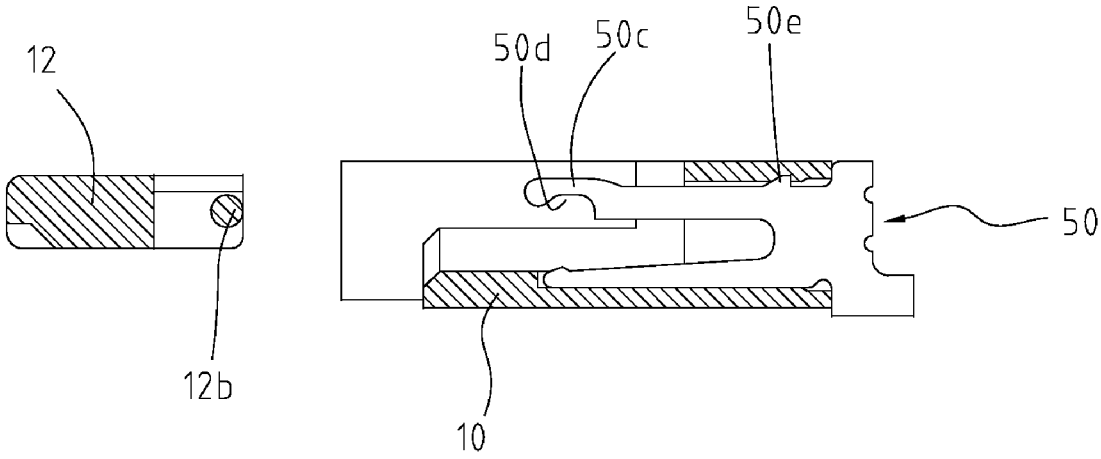
FIGS. 5A to 5E show the five steps that that the terminal of the present invention is inserted into the connector, and the axle is engaged with the notches of the arms of the terminal of the present invention.
Figure 5B:
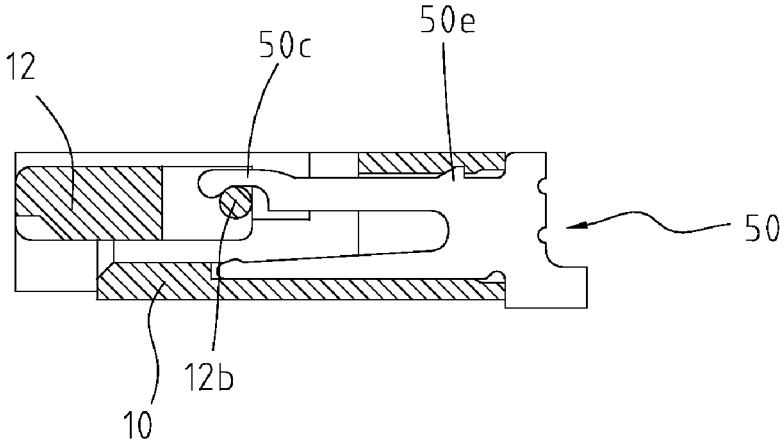

As shown in FIGS. 5A and 5B, when the terminal 50 extends through the passage of the connector 10, the connection portion 50*c* is pushed downward so that the terminal 50 can be easily inserted into the passage of the connector 10 because the passage is narrower than the span of the contact arm 50*a* and the connection arm 50*b*. The cover 12 is then pivotably connected to the connector 10 by engaging the positioning rods of the cover 12 with the engaging recesses of the connector 10. The connection arm 50*b* is pushed upward when contacting the axle 12*b* and the axle 12*b* is then engaged with the notch 50*d* as shown in FIG. 5B. The sharp plate 50*e* is in contact with an inside of the passage of the connector 10 so as to prevent the terminal 50 from being disengaged from the passage by the movement of the axle 12*b* of the cover 12.

Figure 5C:
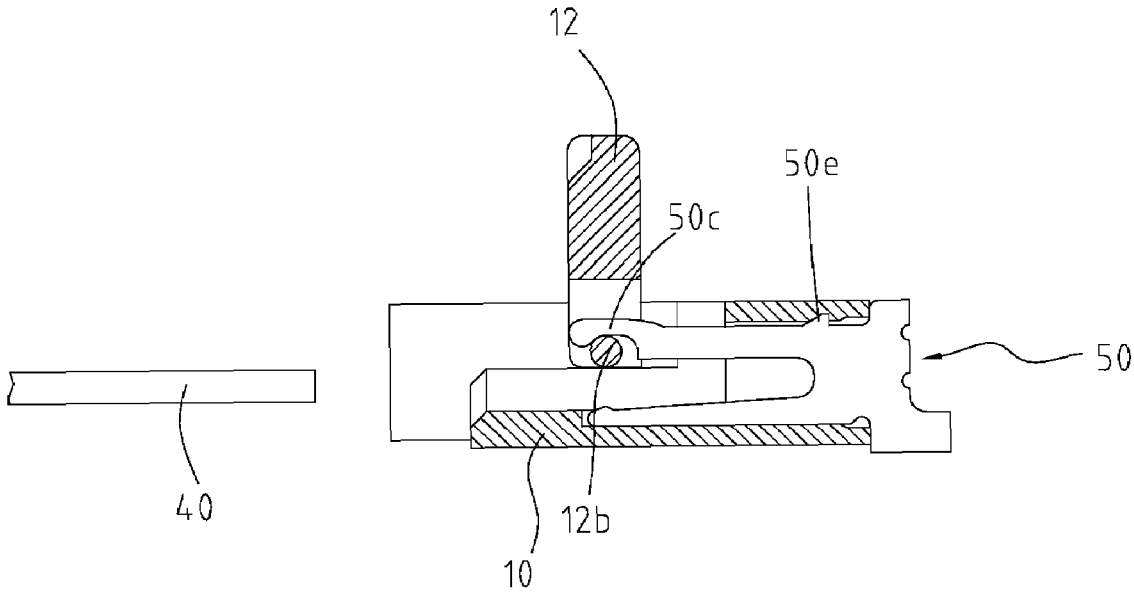
Figure 5D:
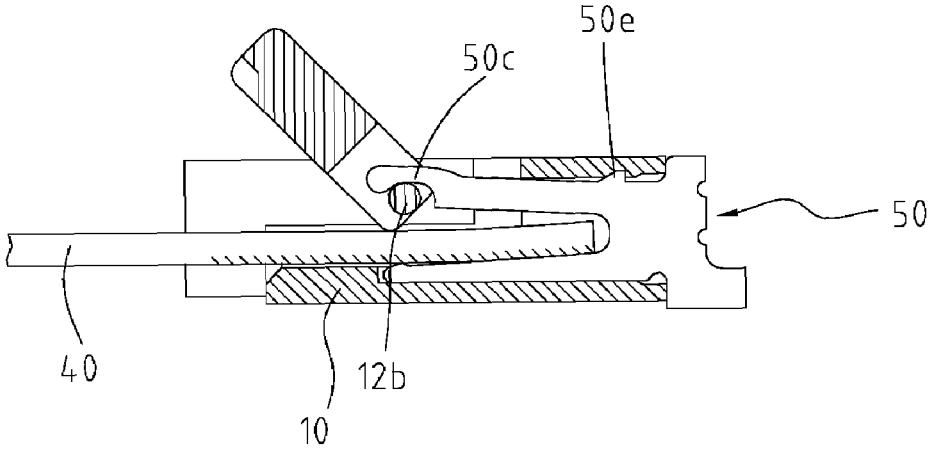
Figure 5E:
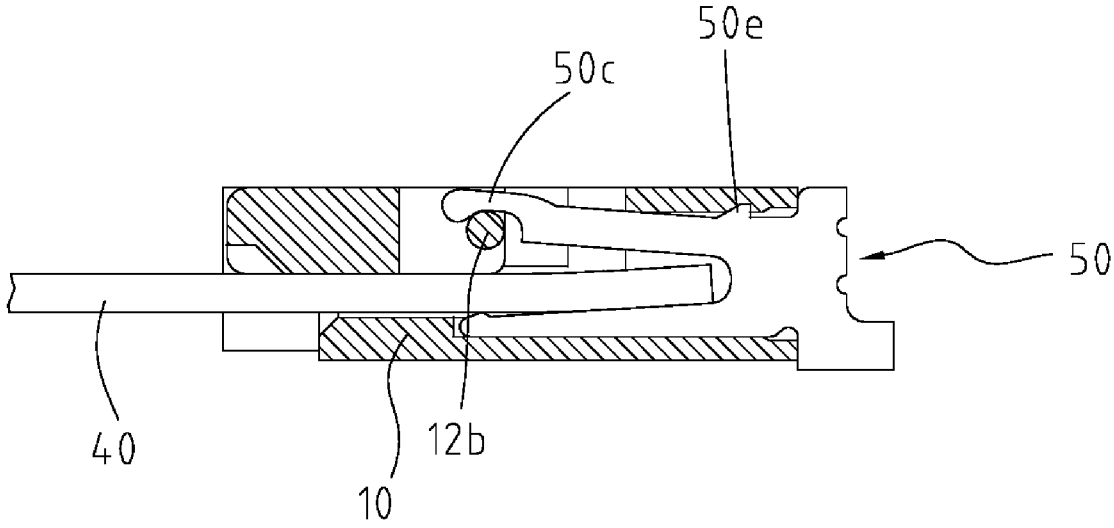

As shown in FIGS. 5C to 5E, the cover 12 pivoted upward to its open position and a flatcable 40 is inserted into the space. The cover 12 is then pivoted downward to its close position and the flatcable 40 is clamped between the cover 12 and the contact arm 50*a*. The flatcable 40 has line contact ends which are in contact with the terminal contact end 50*f* of the terminal 50. During the pivotal actions of the cover 12, the connection arm 50*b* is positioned by the sharp plate

50*e* and the axle 12*b* is engaged with the notch 50*d* of the connection portion 50*c* so that the cover 12 is well positioned.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A method for connecting a terminal to a connector comprising the following steps:

providing a connector which includes a passage defined in a rear end thereof and two engaging recesses defined in two ends of the connector;

providing a cover having two positioning rods on two ends thereof, the positioning rods being engaged with the engaging recesses, a plurality of engaging teeth defined in an underside of the cover and an axle passing through the engaging teeth with two ends of the axle being the two positioning rods;

providing a terminal which has a base from which a contact arm and a connection arm extend, the contact arm having a terminal contact end at a distal end thereof, the connection arm having a connection portion projecting from a distal end thereof and a notch defined in the connection portion, a sharp plate extending from a top side of the connection arm;

inserting the terminal through the passage of the connector by pushing the connection portion downward so as to be inserted into the passage of the connector which is narrower than the span of the connection arm and the contact arm; and engaging the cover pivotably with the connection arm whose connection portion is pushed upward when the connection arm contacts the axle, the axle being engaged with the notch, the sharp plate being in contact with an inside of the passage of the connector to prevent the terminal from being disengaged from the passage.

2. The method as claimed in claim 1, wherein the terminal is a metal plate.

3. The method as claimed in claim 1, wherein a space is defined between the passage and the engaging recesses of the connector.

4. The method as claimed in claim 3 further comprising the following steps:

pivoting the cover to its open position and inserting a flatcable into the space, and pivoting the cover to its close position with the flatcable having line contact ends in contact with the terminal contact end of the terminal.

5. A combination of a terminal and a connector wherein the connector includes a passage defined in a rear end thereof and two engaging recesses are defined in two ends of the connector;

a cover has two positioning rods on two ends thereof and the positioning rods are engaged with the engaging recesses, a plurality of engaging teeth are defined in an underside of the cover and an axle passes through the engaging teeth with two ends of the axle being the two positioning rods, and the terminal has a base from which a contact arm and a connection arm extend, the contact arm has a terminal contact end at a distal end thereof, the connection arm has a connection portion projecting from a distal end thereof and a notch is defined in the connection portion for engaging with the axle, and a sharp plate extends from a top side of the connection arm;

and wherein the passage is narrower than the span of the contact arm and the connection arm so that the connection arm has to be pushed downward for inserting the terminal through the passage of the connector.

6. The combination as claimed in claim 5, wherein the terminal is a metal plate.

7. The combination as claimed in claim 5, wherein a space is defined between the passage and the engaging recesses of the connector, a flatcable is inserted into the space, and the flatcable has line contact ends which are in contact with the terminal contact end of the terminal.

* * * * *